US010341795B2

(12) United States Patent
Fraundorf et al.

(10) Patent No.: US 10,341,795 B2
(45) Date of Patent: Jul. 2, 2019

(54) LOG COMPLEX COLOR FOR VISUAL PATTERN RECOGNITION OF TOTAL SOUND

(71) Applicant: The Curators Of The University Of Missouri, Columbia, MO (US)

(72) Inventors: Philip Fraundorf, St. Louis, MO (US); Stephen Wedekind, Denver, CO (US); Wayne Garver, St. Louis, MO (US)

(73) Assignee: The Curators of the University of Missouri, Columbia, MO (US)

( * ) Notice: Subject to any disclaimer, the term of this patent is extended or adjusted under 35 U.S.C. 154(b) by 0 days.

(21) Appl. No.: 15/824,428

(22) Filed: Nov. 28, 2017

(65) Prior Publication Data

US 2018/0152799 A1 May 31, 2018

Related U.S. Application Data

(60) Provisional application No. 62/427,499, filed on Nov. 29, 2016.

(51) Int. Cl.
*H04R 29/00* (2006.01)
*H04S 7/00* (2006.01)

(52) U.S. Cl.
CPC ..... *H04R 29/008* (2013.01); *H04S 7/40* (2013.01); *H04S 2400/13* (2013.01)

(58) Field of Classification Search
CPC ..... H04R 29/008; H04S 7/40
USPC ..... 381/56–57, 306, 333, 388
See application file for complete search history.

(56) References Cited

U.S. PATENT DOCUMENTS 5,614,840 A * 3/1997 McClintock ..... H03K 19/17704 326/39
8,213,648 B2 * 7/2012 Kimijima ..... H04S 7/302 381/17
8,368,715 B2 * 2/2013 Kimijima ..... H04S 7/30 345/589
9,281,793 B2 * 3/2016 Cheever ..... H03G 5/00
2008/0130918 A1 * 6/2008 Kimijima ..... H04S 1/007 381/107

OTHER PUBLICATIONS

Bank, "Logarithmic frequency scale parallel filter design with complex and magnitude-only specifications," IEEE Signal Processing Letters, Feb. 2011, vol. 18, No. 2, pp. 138-141.
Bartsch et al., "To Catch a Chorus: Using Chroma-Based Representations for Audio Thumbnailing," IEEE Workshop on Applications of Signal Processing to Audio and Acoustics, Oct. 21024, 2001, pp. 15-18.
Brown, "An efficient algorithm for the calculation of a constant Q transform," Journal of the Acoustical Society of America, Nov. 1992, vol. 92, No. 5, pp. 2698-2701.
(Continued)

*Primary Examiner* — Disler Paul
(74) *Attorney, Agent, or Firm* — Armstrong Teasdale LLP

(57) ABSTRACT

The present disclosure is generally directed to audio visualization methods for visual pattern recognition of sound. In particular, the present disclosure is directed to plotting amplitude intensity as brightness/saturation and phase-cycles as hue-variations to create visual representations of sound.

20 Claims, 17 Drawing Sheets
(17 of 17 Drawing Sheet(s) Filed in Color)

(56) References Cited

OTHER PUBLICATIONS

Brown, "Calculation of a constant Q spectral transform," Journal of the Acoustical Society of America, Jan. 1991, vol. 89, No. 1, pp. 425-434.
Cazden, "Pythagoras and Aristoxenos reconciled," Journal of the American Musicological Society, 1958, vol. 11, No. 2-3, pp. 97-105.
Cho et al., "Exploring Common Variations in State of the Art Chord Recognition Systems," Proc. Sound and Music Computing Conference, 2010, 8 pages.
Cowtan, "Kevin Cowtan's Picture Book of Fourier Transforms," Oct. 23, 2014, Available online: http://tinyurl.com/cowtan-fourier-duck. (Archived by WebCite® at http://www.webcitation.org/6dAywgqrk), 20 pages.
Fitz et al., "A Unified Theory of Time-Frequency Reassignment," arXiv:0903.3080v1 [cs.SD], Mar. 2009, pp. 1-38.
Flandrin et al., "Time-frequency reassignment—from principles to algorithms," Applications in Time-Frequency Signal Processing, A. Papandreou-Suppappola, Ed., Boca Raton, FL: CRC, 2003, Chapter 5, pp. 179-203.
Flandrin et al., "Time-Frequency Energy Distributions Meet Compressed Sensing," IEEE Trans. Signal Processing, Jun. 2010, vol. 58, No. 6, pp. 2974-2982.
Fraundorf et al., "Digital Darkfield Analysis of Nanoparticle Defects," Microscopy and Microanalysis, 2007, 3 pages.
Fraundorf, P., "Digital Darkfield Decompositions," arXiv:cond-mat/0403017 [cond-mat.mtrl-sci], Feb. 2004, 10 pages.
Fraundorf et al., "Digital darkfield tableaus," Microscopy and Microanalysis, 2006, 2 pages.
Fraundorf et al., "Real time sheet music," [Online], (Jun. 15, 2016), Available: http://tinyurl.com/color-rtsm. (Archived by WebCite® at http://www.webcitation.org/6ilA5qsnY), 29 pages.
Fulop et al., "Algorithms for computing the time-corrected instantaneous frequency (reassigned) spectrogram, with applications," Journal of the Acoustical Society of America, Jan. 2006, vol. 119, No. 1, pp. 360-371.
Giannoulis et al., "Musical Instrument Recognition in Polyphonic Audio Using Missing Feature Approach," IEEE Trans. Audio, Speech, and Language Processing,Sep. 2013, vol. 21, No. 9, pp. 1805-1817.
Härmä et al., "Discrete Representation of Signals on a Logarithmic Frequency Scale," 2001 IEEE Workshop on Applications of Signal Processing to Audio and Acoustics, Oct. 21-23, 2001, pp. 39-42.
Harte et al., "Automatic Chord Identification Using a Quantised Chroma and Harmonic Change Segmentation," Journal of the Audio Engineering Society, 118th Convention, Paper No. 6412, May 2005, 3 pages.
Jin et al., "Log-Frequency Spectrogram for Respiratory Sound Monitoring," IEEE Int. Conference on Acoustics, Speech, and Signal Processing, Mar. 25-30, 2012, pp. 597-600.
Mason, "Comparison of Solo and Ensemble Performances with Reference to Pythagorean, Just, and Equi-Tempered Intonations," Journal of Research in Music Education, 1960, vol. 8, No. 1, pp. 31-38.
Oppenheim et al., "Discrete Representation of Signals," Proc. IEEE, Jun. 1972, vol. 60, No. 6, pp. 681-691.
Púčik et al., "FFT with Modified Frequency Scale for Audio Signal Analysis," Radioelektronika, 24th Int. Conference, Apr. 15-16, 2014, pp. 1-4.
Schörkhuber et al., "Constant-Q Transform Toolbox for Music Processing," Proc. Sound and Music Computing Conference, 2010, 9 pages.
Sundberg, J., "In tune or not? A study of fundamental frequency in music practice," Dept. for Speech, Music and Hearing: Quarterly progress and status report, 1982, vol. 23, No. 1, pp. 49-78.
Ukidave et al., "Analyzing power efficiency of optimization techniques and algorithm design methods for applications on heterogeneous platforms," Int. Journal of High Performance Computing Applications, Aug. 2014, vol. 28, No. 3, pp. 1-16.
Velasco et al., "Constructing an Invertible Constant-Q Transform with Nonstationary Gabor Frames," Proc. 14th Int. Conference on Digital Audio Effects, Paris, France, Sep. 19-23, 2011, pp. 93-99.
Wedekind et al., "Log Complex Color for Visual Pattern Recognition of Total Sound", Audio Engineering Society Convention Paper, Sep. 29-Oct. 2, 2016, 9 pages.
Wu et al., "Global Smartphone Shipments in 2014 Totaled 1.167B with Samsung and Apple as First and Second, TrendForce Reports," TrendForce Corp., [Online]. (Jan. 20, 2015) Available: http://tinyurl.com/2014-smartphone-sales. (Archived by WebCite® at http://www.webcitation.org/6dAzSZbpF), 3 pages.
Xiao et al., "Multitaper time-frequency reassignment for nonstationary spectrum estimation and chirp enhancement," IEEE Trans. Signal Processing, Jun. 2007, vol. 55, No. 6, pp. 2851-2860.

* cited by examiner

LOG COMPLEX COLOR FOR VISUAL PATTERN RECOGNITION OF TOTAL SOUND

CROSS-REFERENCE TO RELATED APPLICATION

This application claims the benefit of U.S. Provisional Patent Application Ser. No. 62/427,499, filed Nov. 29, 2016, the entire contents of which are incorporated herein by reference.

BACKGROUND OF THE DISCLOSURE

The present disclosure is generally related to audio visualization methods for visual pattern recognition of sound. In particular, the present disclosure is directed to plotting amplitude intensity as brightness/saturation and phase-cycles as hue-variations to create visual representations of sound.

While traditional audio visualization methods depict amplitude intensities vs. time, such as in a time-frequency spectrogram, and while some may use complex phase information to augment the amplitude representation, such as in a reassigned spectrogram, the phase data are not generally represented in their own right. By plotting amplitude intensity as brightness/saturation and phase-cycles as hue-variations, the complex spectrogram method described herein displays both amplitude and phase information simultaneously, making the resulting images canonical visual representations of the source wave.

As disclosed herein, encoding log-amplitude visualization of complex-number amplitude and phase (over a wide range of intensities) into a single pixel allows for visualization of total sound. That is, visualization is provided for the total sound coming into a microphone such that every pressure front in time as it impacted the microphone's transducer is reconstructed from the resulting image. As a result, in some embodiments, the original sound is precisely reconstructed (down to the original phases) from an image, by reversing this process. This allows humans to apply their highly-developed visual pattern recognition skills to complete audio data in a new way. Applications of these methods, for example, include making "visual field guides" to sounds, as well as online image generation for sound visualization through mobile devices running browsers (e.g., in real-time and/or "without tiling of time-slices").

SUMMARY OF THE DISCLOSURE

One aspect of the present disclosure describes an audio visualization method for recognition of a sound. The method comprises capturing a sound, creating a logarithmic color amplitude of the sound, creating a coefficient phase angle of the sound, and displaying the amplitude and phase of the sound simultaneously to generate an image of the sound.

Another aspect of the present disclosure describes a method of reconstructing a sound from an image. The method comprises capturing a sound, creating a logarithmic color amplitude of the sound, creating a coefficient phase angle of the sound, displaying the amplitude and phase of the sound simultaneously to generate an image of the sound, and reverse processing the generated image to recover the sound.

Yet another aspect of the present disclosure describes a method of recreating a sound on a real-time basis. The method comprises capturing a sound, creating a logarithmic color amplitude of the sound, creating a coefficient phase angle of the sound, and displaying the amplitude and phase of the sound simultaneously to generate an image of the sound. The method further comprises analyzing the image of the sound and recreating the sound.

BRIEF DESCRIPTION OF THE DRAWINGS

The patent application file contains at least one drawing executed in color. Copies of this patent or patent application publication with color drawing(s) will be provided by the Office upon request and payment of the necessary fee.

DETAILED DESCRIPTION OF THE DISCLOSURE

Figure 1:
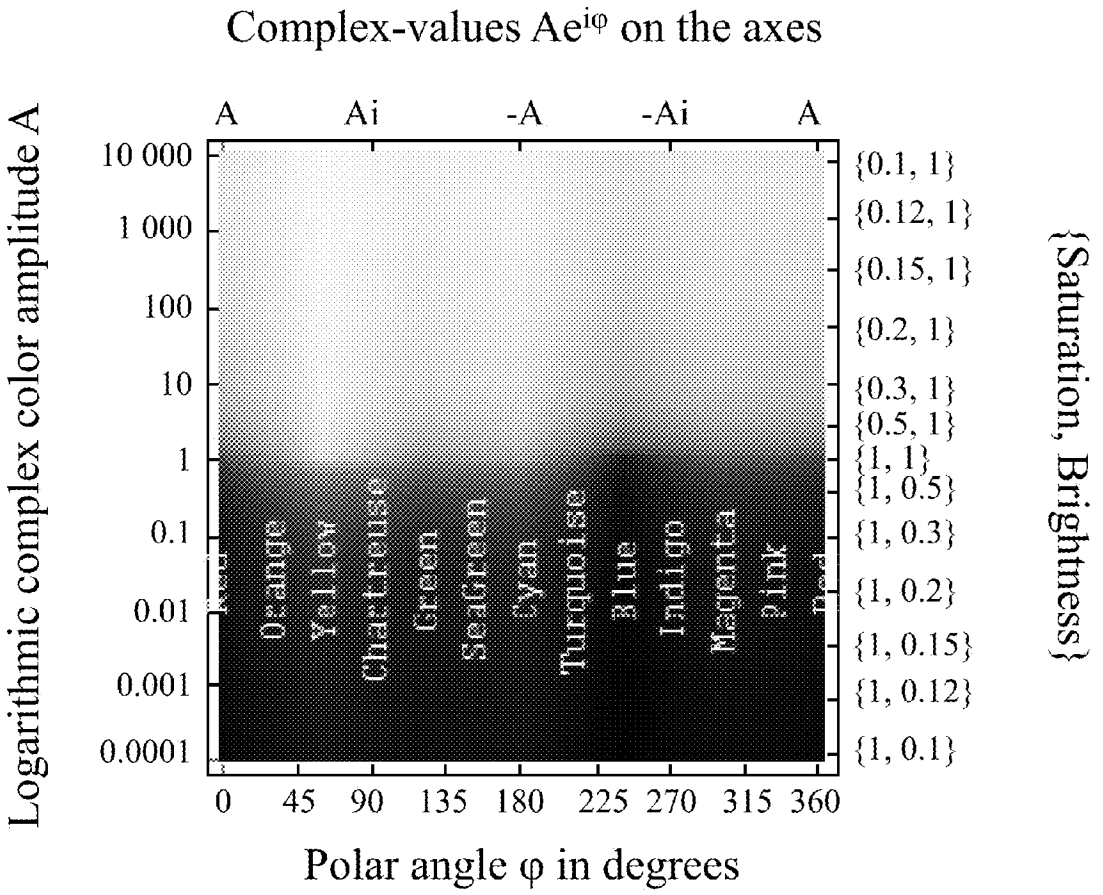
FIG. 1 depicts an exemplary embodiment of a logarithmic complex-color key in polar coordinates with amplitude on the logarithmic vertical axis and imaginary phase angle $\varphi$ on the linear horizontal axis in accordance with the present disclosure.

In some embodiments of the present disclosure, audio visualization methods for visual pattern recognition of sound are disclosed. In particular, plotting amplitude intensity as brightness/saturation and phase-cycles as hue-variations to create visual representations of sound is described.

While some current audio visualization methods use the complex fast Fourier transform (FFT) components to augment the accuracy of (real) amplitude readings, they tend to be highly application-specific, and do not appear concerned with the significance of generalized, total-sound analysis, by which simultaneous display of both amplitude and phase data in each pixel provides a canonical means of recording, analyzing, cataloguing, and displaying more sound than humans are generally considered capable of hearing. Disclosed herein is an efficient and robust real-time method of viewing total sound spectrographs that incorporates log-intensity (for improved dynamic range) amplitude-visualization combined with chroma-like phase-visualization. By simultaneously displaying both real and imaginary FFT data-sets, the resulting image is ensured to contain all the information of the original source, meaning it is always possible to recover the original sound from any image generated with this method, down to the original phases.

This presents alternative data storage techniques, novel cataloguing methods such as visual sound field-guides (which, when combined with a mobile real-time visualization app could allow for live imitation-feedback), improved sound-availability for the hearing-impaired, and more. Additional modifications that include, e.g., Grand Staff musical overlay and/or stereo versions for wearable devices help music readers without specific technical backgrounds and/or sensory capabilities to make sense of such total-sound visualizations. The ever-increasing capability of modern mobile devices can already support implementation of this visualization method, leveraging their wide distribution as well as their pre-installed microphones, color displays, and processing speeds.

Methods

The study of spatial periodicities in nanocrystalline solids has shown the utility of representing both amplitude and phase with a single pixel, since condensed matter crystals contain periodicities in two and three spatial dimensions, and so require higher dimensional FFTs rather than the one time-dimension periodicities involved in audio analysis. By applying this visualization method to audio signals, the complete, complex FFT of a given time-slice is displayed as a single column of pixels, allowing the horizontal axis to remain available for sequential slices in the time domain.

In contrast to current audio visualization methods like traditional spectrograms, reassigned spectrograms, constant-Q transforms (CQTs), and chroma features which use various techniques to optimize amplitude visualization, a simpler scheme is applied herein based on complex FFTs that simultaneously display the amplitude and phase information associated with each pixel. As in many other applications, not the least of which is the traditional Western musical notation, logarithmic scaling of the frequency axis is optionally adopted for some embodiments, since on it octaves and harmonics are equally spaced. While techniques like reassigned spectrograms utilize the imaginary part of the Fourier transform to enhance accuracy of particular amplitude and harmonic representations, and chroma (i.e., saturation of a distinctive hue of color) visualizations show periodic changes in tone as hue-variations, the methods described herein simultaneously display both real and imaginary Fourier data to produce a canonical view of total sound. By showing Fourier coefficient amplitude as the brightness/saturation of the associated pixel, and Fourier phase as hue, each pixel simultaneously represents both real and imaginary components of a complex Fourier coefficient.

On a linear frequency scale, log-color phase-representation begins with each complex Fourier coefficient being converted to a color according to FIG. 1, which depicts a logarithmic complex-color key in polar coordinates with amplitude on the logarithmic vertical axis and imaginary phase angle $\varphi$ on the linear horizontal axis. In such a representation, the hue is determined by the coefficient's phase angle whereas the brightness/saturation is determined by the logarithm of the intensity of the coefficient.

As seen in FIG. 1, Fourier-coefficient phase-shifts in one direction result in a red-to-green-to-blue (RGB) sequence, whereas movement in the opposite direction results in a red-to-blue-to-green (RBG) sequence. Since the frequency scale is linear, the only interpolation involved is that which maps the saturation and brightness from a linear to a logarithmic intensity scale (vertical axis of FIG. 1). By plotting the log of the intensity rather than only the intensity, some fine details are sacrificed in order to provide conventional improvements in dynamic range. Hue, saturation, and brightness parameters between 0 and 1 are determined by equations (1), (2), and (3), respectively. This reversible mapping between complex-number absolute-value and pixel-color thereby trades contrast for dynamic range.

$$h = \frac{\varphi}{2\pi} \tag{1}$$

$$s = \begin{cases} 1 & \text{if } A \le 1 \\ \dfrac{1}{1 + \ln[A]} & \text{if } A > 1 \end{cases} \tag{2}$$

$$b = \begin{cases} \dfrac{1}{1 - \ln[A]} & \text{if } A \le 1 \\ 1 & \text{if } A > 1 \end{cases} \tag{3}$$

In order to achieve the benefits of the log-frequency scale from equally spaced samples in the time-domain, the linear-frequency data must be transformed, limiting the retention of some detailed sound information in favor of a more robust visual representation. In particular, since the transformation from linear- to log-frequency expands the lower-frequency coefficients and compresses the higher-frequency coefficients along the vertical axis, the lower-frequency coefficients (those below about 1200 Hz) require interpolation to sufficiently inform the brightness values for the multiple rows of a single coefficient. In contrast, the higher-frequency coefficients are under-sampled so that only coefficients closest to display-rows are represented. This optional nonlinear transformation of the frequency axis allows the discrete time-frequency spectrogram to be "warped" (different frequencies stretched or compressed differently, but frequency-order preserved) without being "scrambled" (order of represented frequencies not preserved), making it more amenable to visual pattern recognition techniques.

The log-frequency display is then rendered by first completing the linear-frequency counterpart as described above and then by mapping the vertical axis to a log-frequency scale. At lower frequencies, this requires interpolation between complex-valued coefficients, for which there are two methods. Complex-color log-frequency interpolation of Fourier coefficients for a 10% frequency-modulated tone centered around 256 Hz are shown using rectangular (FIG. 2A) versus using polar (FIG. 2B) interpolation. Color rotation from red-to-green-to-blue (RGB) indicates that the oscillation frequency is above the Fourier coefficient center, and rotation from red-to-blue-to-green (RBG) indicates an oscillation frequency below the center of the Fourier coefficient.

While both polar and rectangular interpolation routines were applied to this task, rectangular interpolation (FIG. 2A) was found to be preferable to polar interpolation (FIG. 2B) by showing small variations in Fourier coefficient phase at the onset of each time-slice as colored stripes. This is because the rectangular approach produces a plot that is interpreted based on existing knowledge of phases and coefficient centers, whereas the polar approach contains an inherent ambiguity in phase assignment. Consequently, the method defers to rectangular interpolation (FIG. 2A) for extracting meaningful Fourier phase information from audio data. The newly interpolated phase-angles are then represented as colors as shown in FIG. 1. In each FIG. 2A and FIG. 2B, the two groups each of five white horizontal lines correspond to the lines of the treble and bass clef of the traditional Grand Staff musical notation.

Since each Fourier coefficient corresponds to a frequency range determined by the FFT size, a coefficient "center" is where a linear coefficient index plots on the log-frequency scale. Since tiny changes in amplitude are detected by examining more-sensitive phase-variations, mapping Fourier phase to hue allows frequency-variations well below the resolution allowed by a typical FFT size to be visualized from one time-slice to the next as colored stripes. In this way, rougher frequency data are shown with brightness/saturation, while the finer details are represented in color. Assuming a sampling rate of 44.1 kHz and a 2048 FFT size, the separation of coefficient centers is 44100/2048~21.533 Hz.

At various points between coefficient centers, rectangular interpolation results in zero-amplitude phase-inversions. During these transitions, the interpolated phases switch from being above the center of the lower coefficient to being below the center of the higher coefficient, or vice versa, at which point the Fourier phase undergoes an inversion. At these intersections, the interpolated amplitudes reach zero before immediately becoming positive again. The effect is that black lines appear between coefficient centers with alternating color rotations on either side. Such black lines are artifacts of the rectangular phase-interpolation routine, and, as an exception, do not actually correspond to zero-intensities in the input signal. This effect is seen in practice in FIG. 2A.

Results

Figure 2A:
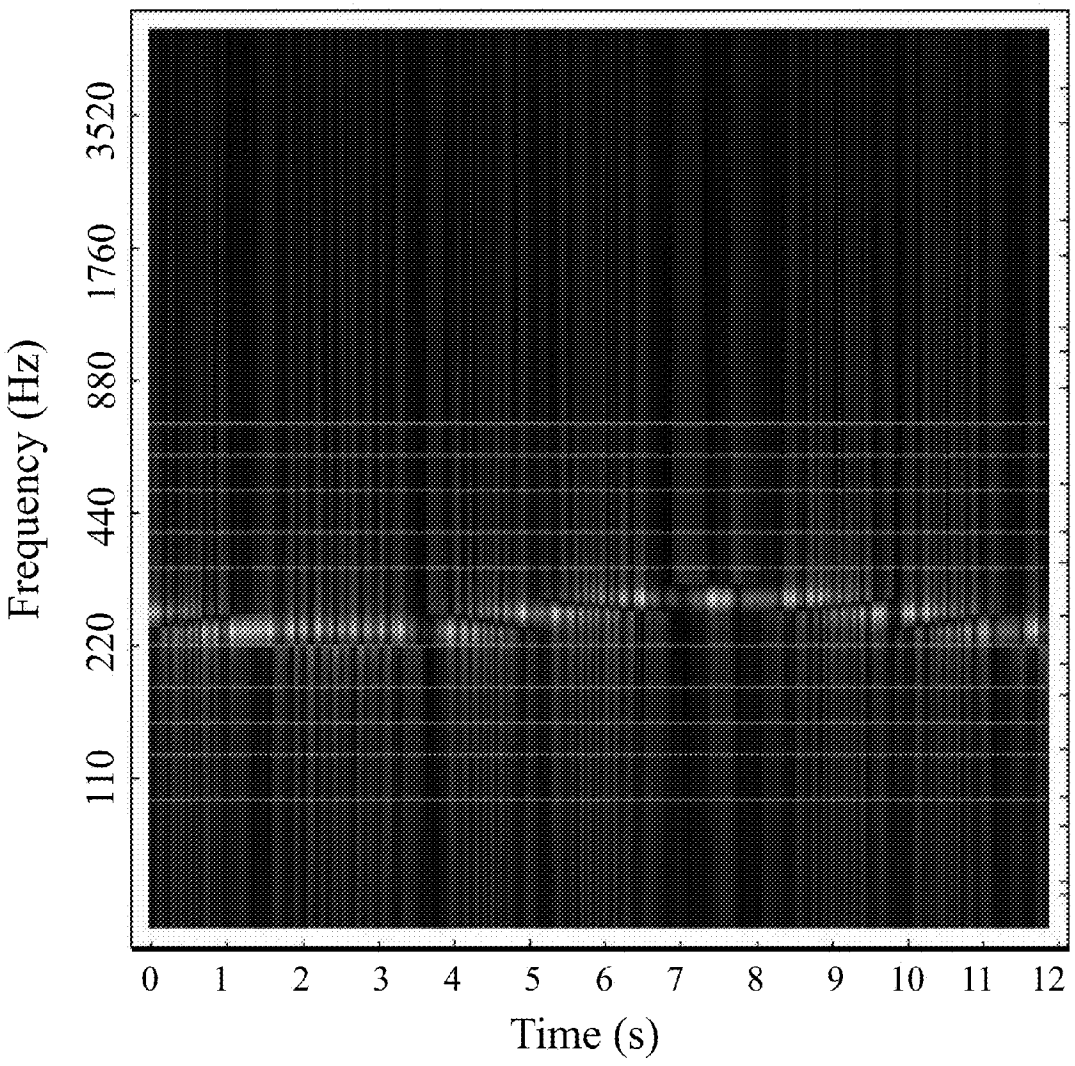
FIG. 2A depicts an exemplary embodiment of a rectangular complex-color log-frequency interpolation of Fourier coefficients for a 10% frequency-modulated tone centered around 256 Hz in accordance with the present disclosure.
Figure 2B:
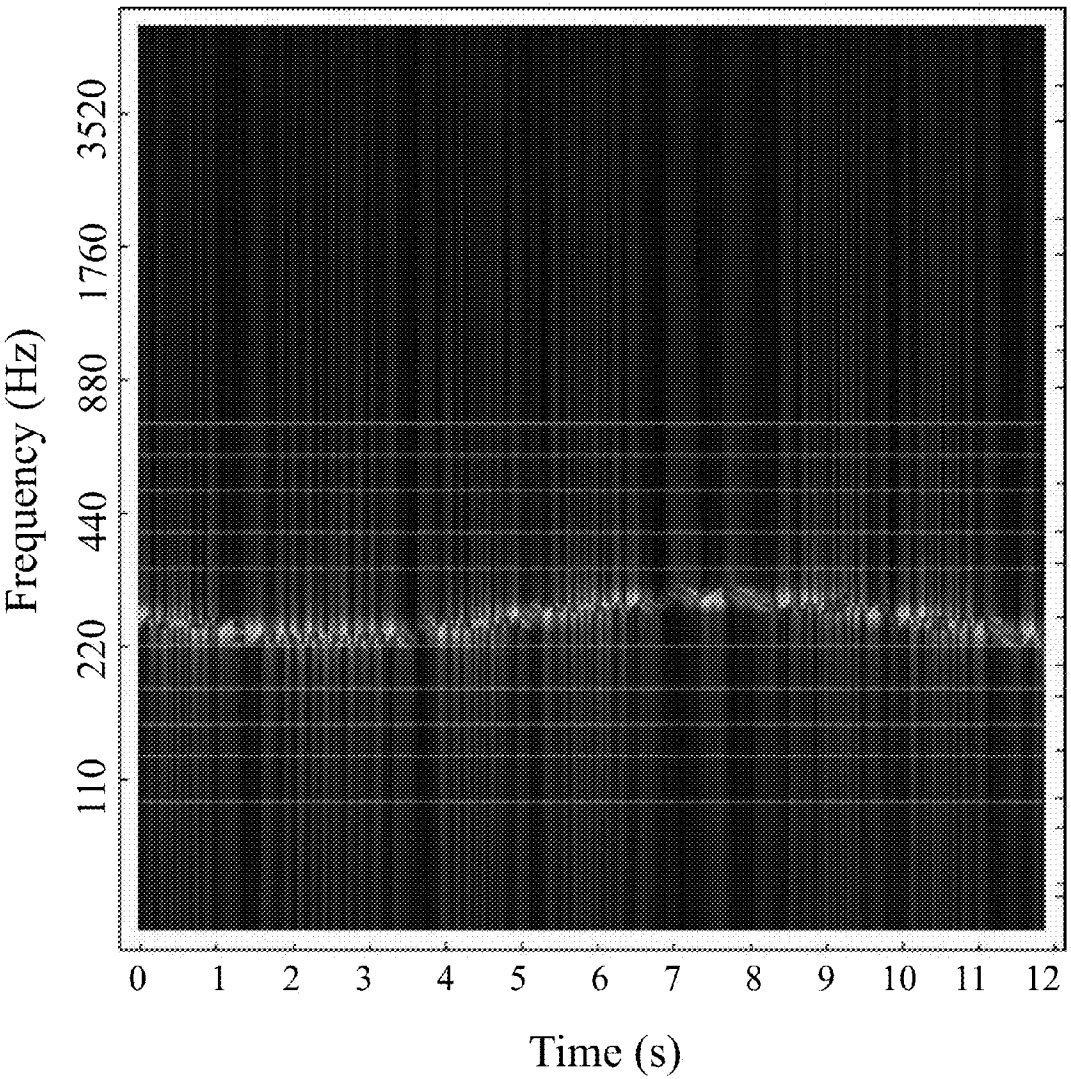
FIG. 2B depicts an exemplary embodiment of a polar complex-color log-frequency interpolation of Fourier coefficients for a 10% frequency-modulated tone centered around 256 Hz in accordance with the present disclosure.

Realizations of this log-color visualization method in HTML5/JavaScript have been shown to process and render audio signals on a variety of hardware platforms in about one-third the time necessary to maintain real-time synchronization. Since this method for showing variation in phase among Fourier coefficients allows for the representation of a complex number by a single pixel, the entire FFT is conveniently displayed as a vertical line of colored pixels with the brightness corresponding to the log of the intensity of the Fourier coefficient and the hue corresponding to the coefficient-phase. In the time direction, steady variations in Fourier-coefficient phase at the onset of each time-slice are seen as colored stripes, with stripes of opposing sequence (RGB vs. RBG) occupying opposite sides of the zero-amplitude lines. When the oscillation frequency is below the center of a coefficient, the hue alternates in the RBG direction, and when the oscillation frequency is above a Fourier-coefficient center, the hue alternates in the RGB direction, as seen in FIG. 2A. For a static tone, the frequency-misalignment, in Hertz, with the Fourier-coefficient hardware-reference-frequency was found to be equal to the number of color-cycles in a one-second interval.

Figure 3:
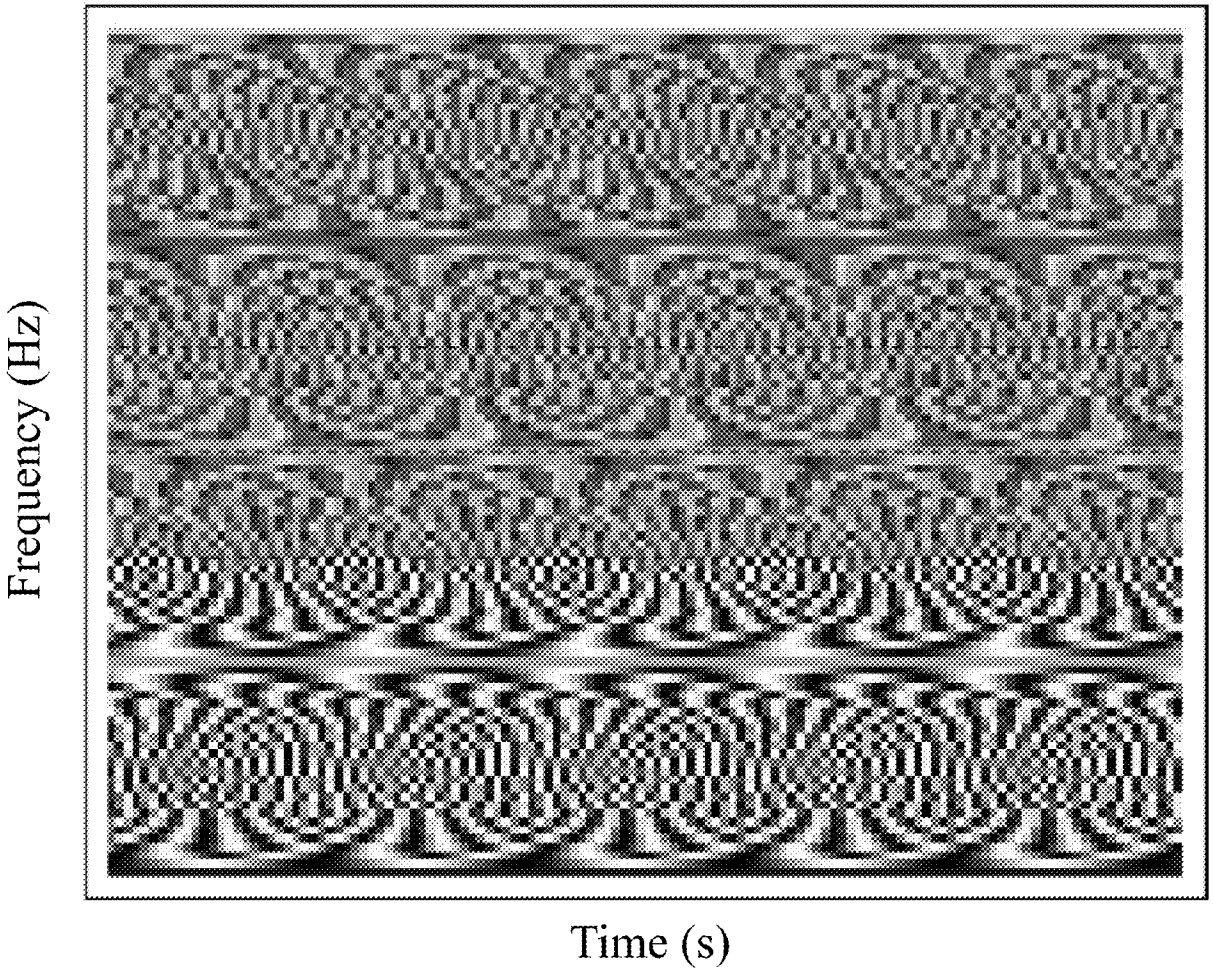
FIG. 3 depicts an exemplary embodiment of a composite beat-schematic in accordance with the present disclosure.

Whenever the phase is centered on the Fourier coefficient, the hue remains constant, which allows highly accurate, well-centered data points to be easily distinguished and isolated even in real-time. In fact, the color-oscillations have a period inversely proportional to the frequency offset from the coefficient center, just as do amplitude beats used to tune woodwind instruments (see FIG. 3). Plotted in FIG. 3 is a composite beat-schematic, with 128 vertical time-slices arrayed across the horizontal axis, and 4 center-to-center frequency-coefficients on the vertical axis. Each frequency-coefficient in FIG. 3 is divided into 25 lines with randomized phase-offsets to highlight beat-oscillations as a function of the frequency-offset from the coefficient-center (solid color lines). The central dashed line in FIG. 3 marks the center of one frequency coefficient, with top and bottom boundaries ⅛th of the height away in each direction. The top ⅝ths of the plot show color phase-beats with respect to coefficient center, while the bottom ⅜ths shows monochrome amplitude-beats with respect to a coefficient-centered note.

Discussion

The connection of technologies like microphones, digital displays, and computing power with currently-existing, globally-interconnected, wireless networks of highly-portable devices provides a historically unique opportunity to drastically expand the scope of applications for visual audio analysis. In addition, versatile phase-sensitive audio-analysis applications incorporating both modern (log-frequency) and traditional (Grand Staff) optimizations for enhancing visual pattern recognition provide a meaningful (or at least relatable) basis from which anyone with experience reading music may make interpretations of phase-detailed audio data.

Several exemplary embodiments of applications involving these features are illustrated in FIGS. 4A-4J and considered as sample uses for a mobile device application as proposed herein.

Figure 4A:
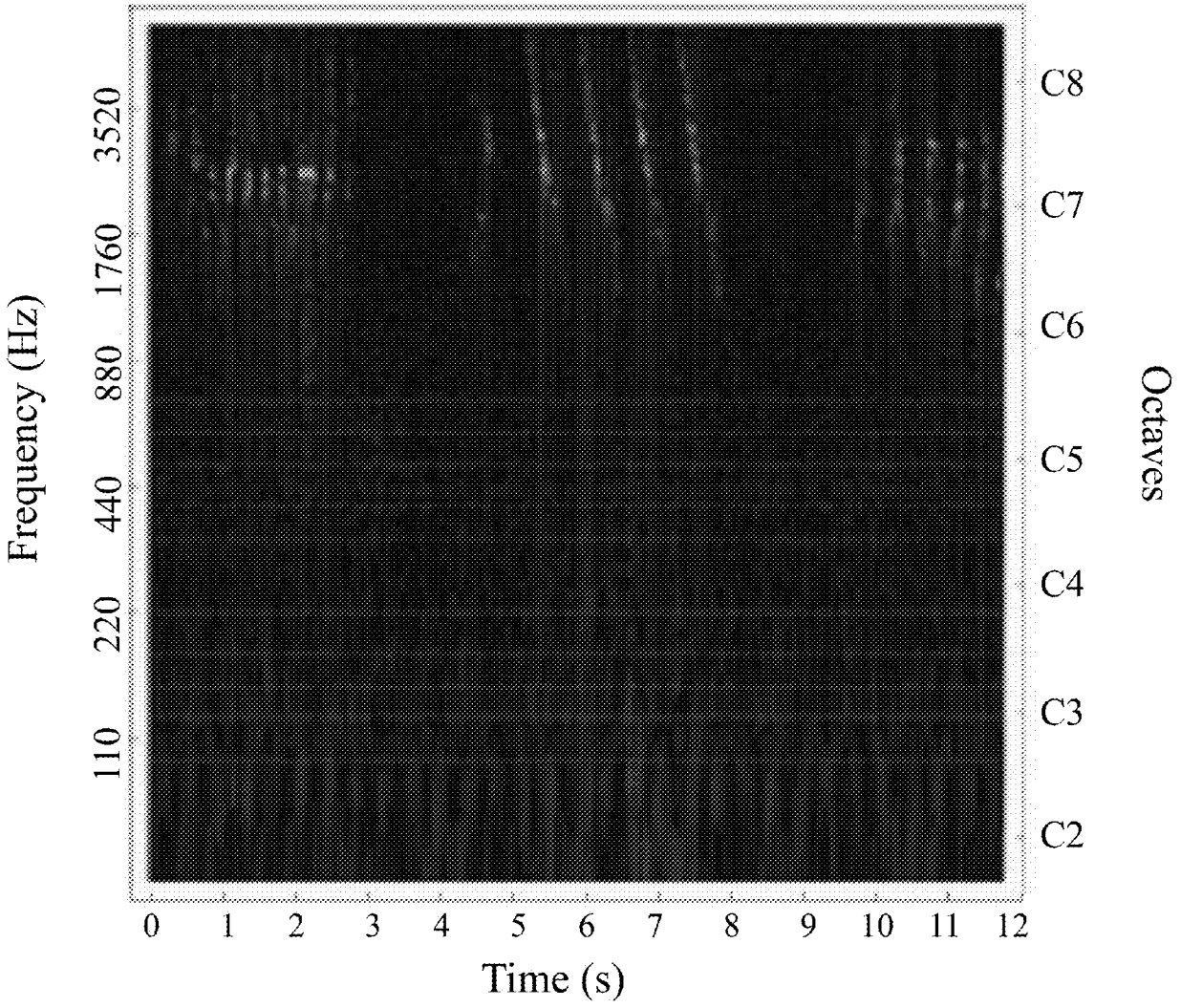
FIG. 4A depicts an exemplary embodiment of a logarithmic complex color visualization of a northern cardinal bird call in accordance with the present disclosure.

FIG. 4A illustrates a logarithmic complex color visualization of a northern cardinal bird call. The inclusion of relevant sound images in text- or print-based media (such as bird-sound field-guides as suggested by panel in FIG. 4A) allows users without appropriate hardware to take advantage of this technology by applying independent pattern-recognition analysis to existing sound-images. Moreover, in some embodiments, such printed images are used in conjunction with, for example, a mobile-friendly analysis-app to visually compare and classify live captures with sound-visuals of known origin.

Figure 4B:
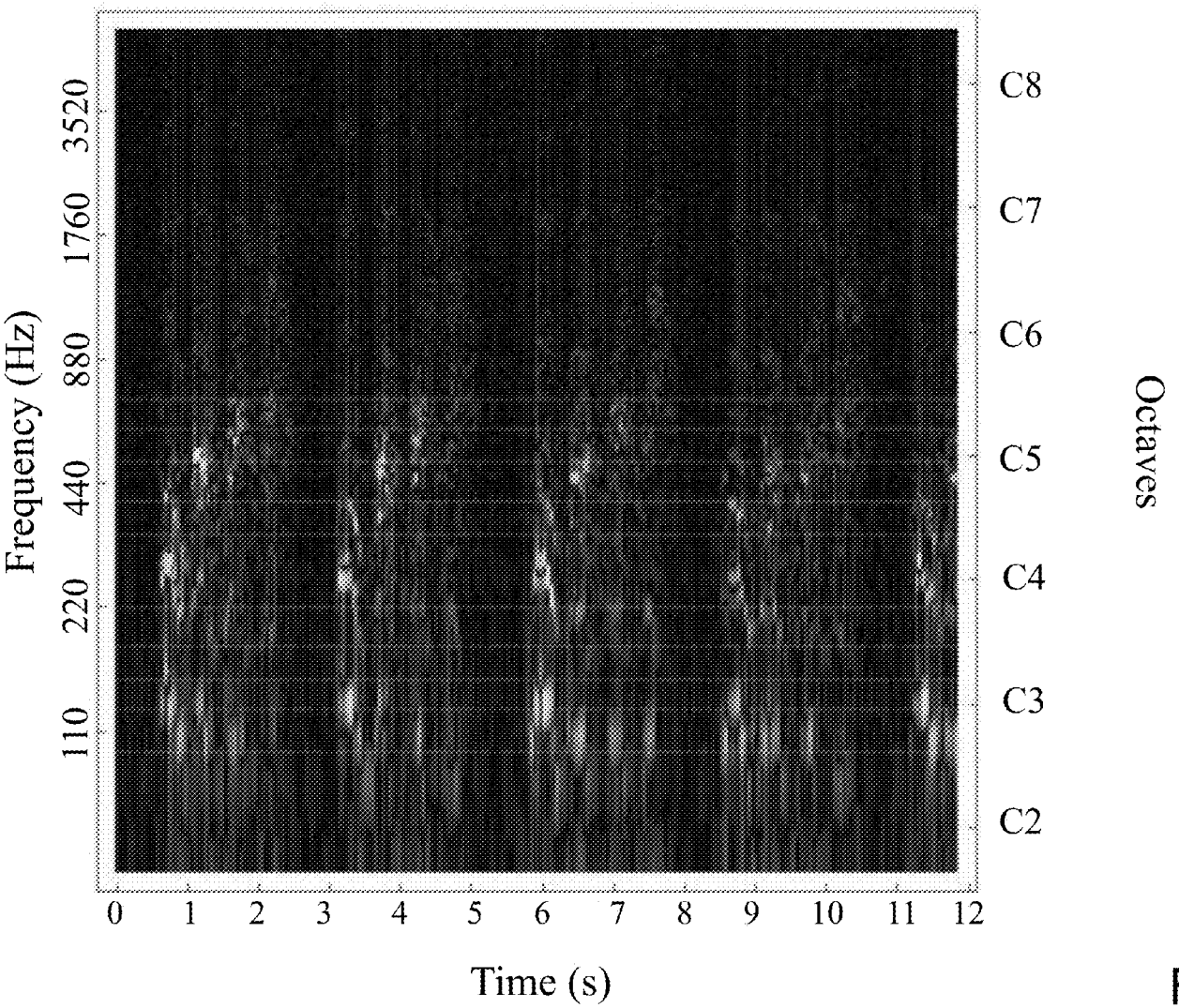
FIG. 4B depicts an exemplary embodiment of a logarithmic complex color visualization showing various Fourier phase shifts and multi-harmonic behavior of a human voice theater exercise in accordance with the present disclosure.

FIG. 4B shows both the colored bands of various Fourier phase shifts and the multi-harmonic behavior of the human voice are readily apparent in the logarithmic complex color visualization of a "woo war wow" theater voice exercise. The right axis lists C-octaves, while the left axis lists frequency in Hertz, and the bottom axis lists time in seconds. A real-time picture of incoming-sound (as in the theater voice example of FIG. 4B) empowers voice imitators as well, even those who are hearing-impaired.

Figure 4C:
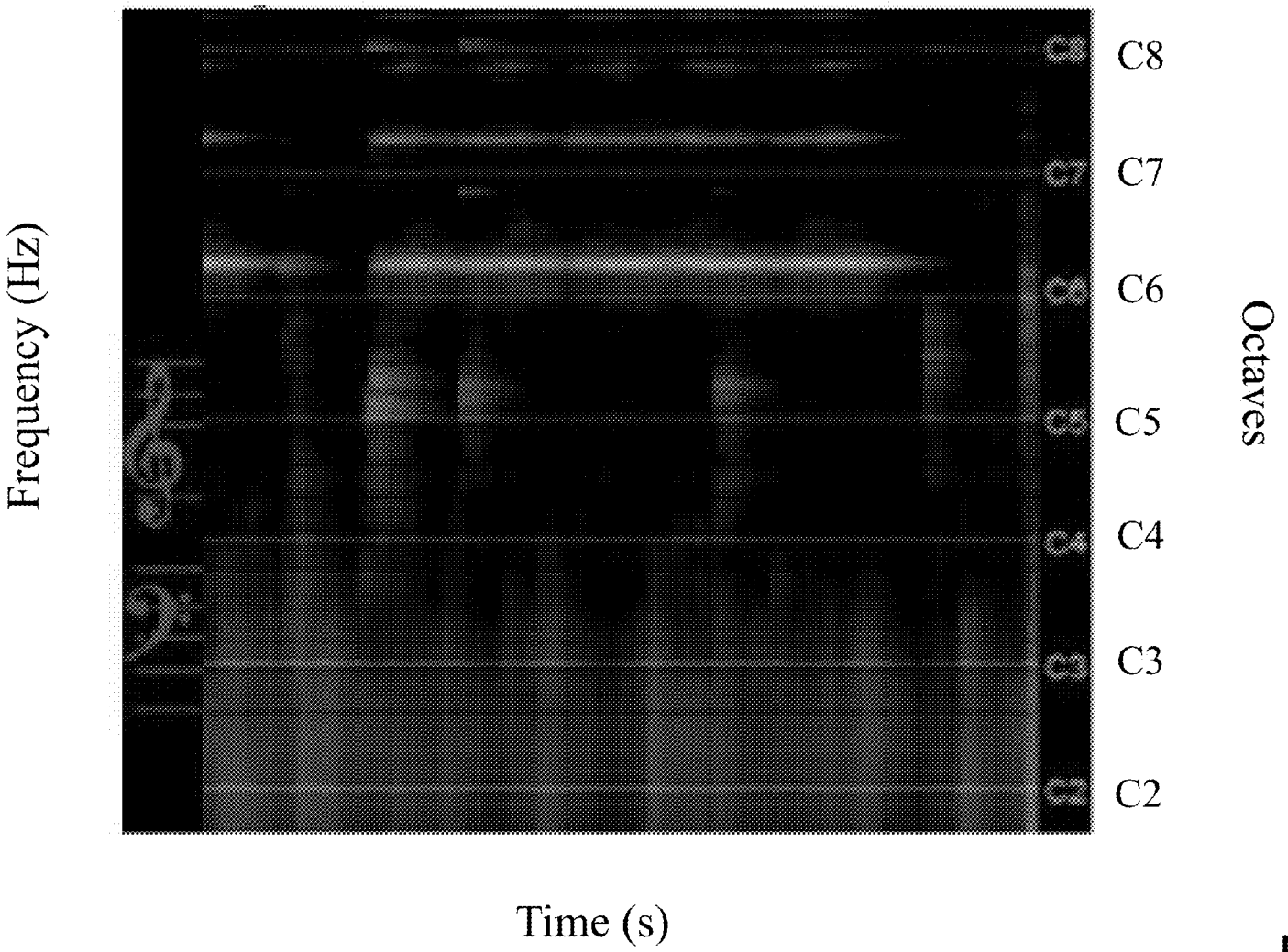
FIG. 4C depicts an exemplary embodiment of an image for half-full wine glass, in grayscale, in accordance with the present disclosure.
Figure 4D:
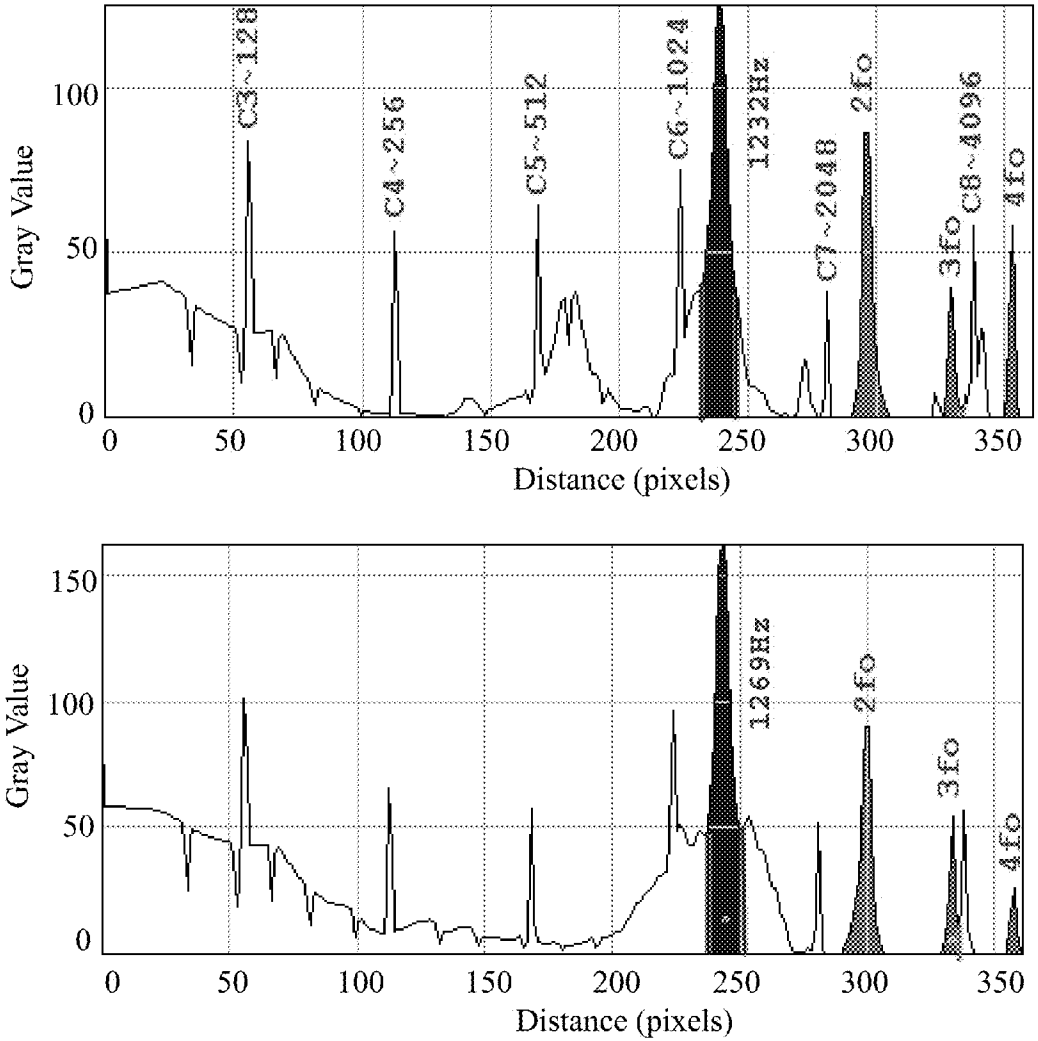
FIG. 4D depicts an exemplary embodiment of an analysis of both a half-full and a quarter-full wine glass in accordance with the present disclosure.

FIGS. 4C and 4D illustrate the utility for home experimenters in the spirit of Google's Science Journal app. FIG. 4C depicts an image for a half-full wine glass (in grayscale). FIG. 4D shows analyses for both a half-full and a quarter-full wine glass.

Figure 4E:
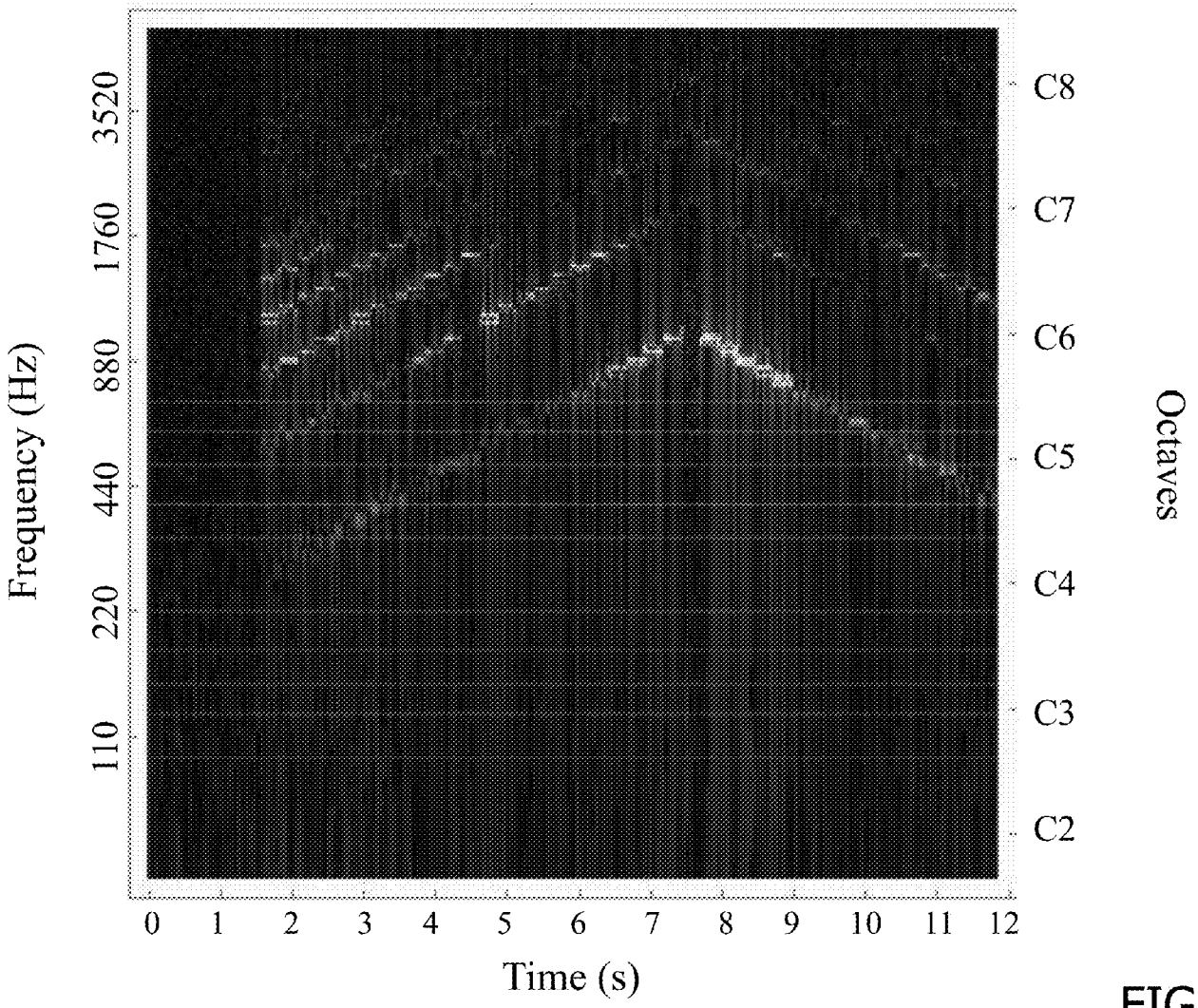
FIG. 4E depicts an exemplary embodiment of a simulated oboe up, clarinet down musical scale illustrating the harmonic profile difference between the two woodwind instruments in accordance with the present disclosure.
Figure 4F:
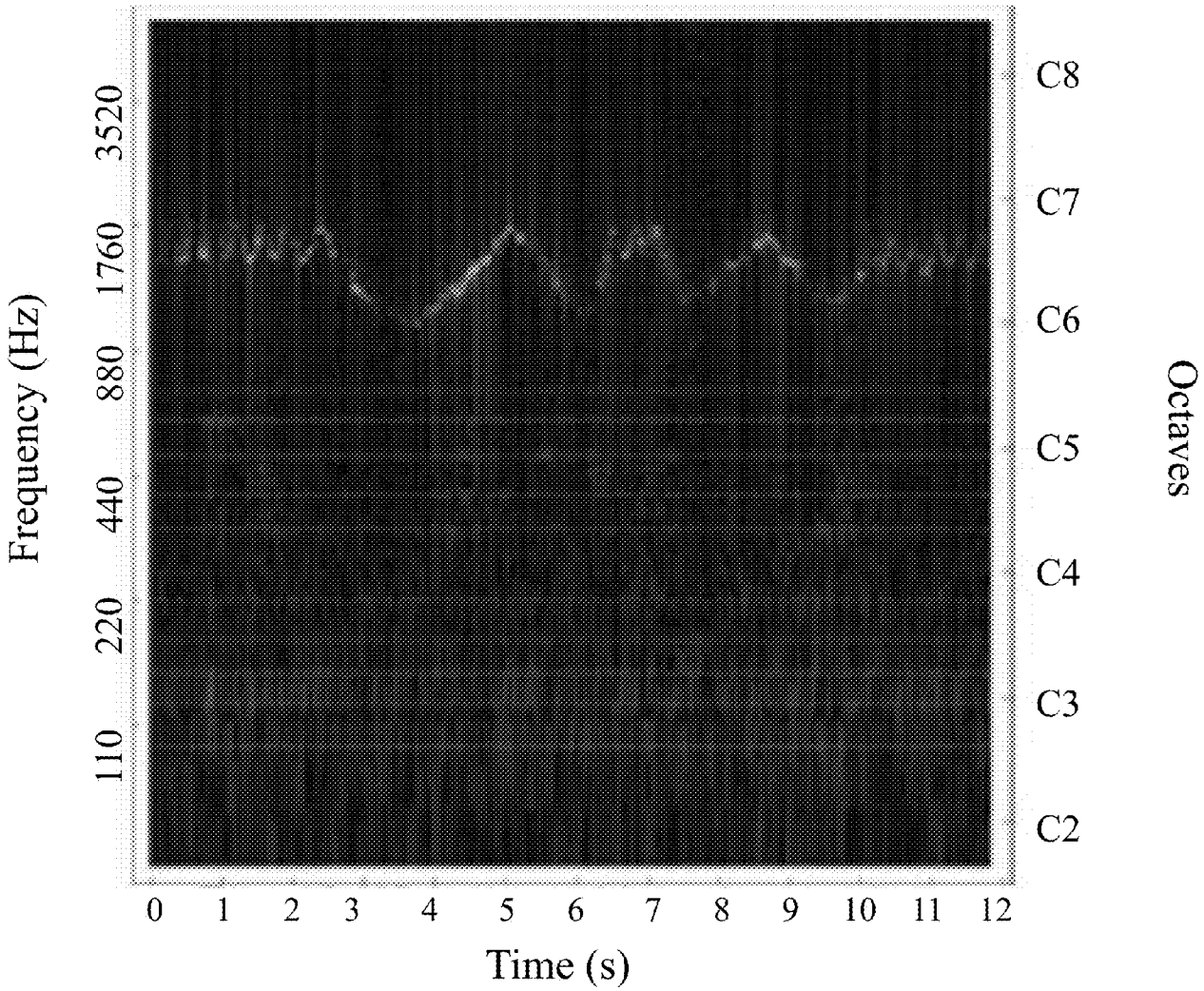
FIG. 4F depicts an exemplary embodiment of a logarithmic complex color visualization of whistling with no harmonics in accordance with the present disclosure.

FIGS. 4E and 4F illustrate visual comparison of musical instrument harmonics. FIG. 4E shows a simulated oboe up, clarinet down musical scale and illustrates the differences in harmonic profiles between the two woodwind instruments. The first harmonic of the oboe is clearly more pronounced than that of the clarinet, and the clarinet's second harmonic is that instrument's most pronounced, after the base signal. Color indicates phase offset from the center frequency of the appropriate Fourier coefficient at the outset of each time-slice (according to FIG. 1), and the brightness/saturation of a given pixel indicates the logarithm of the amplitude of the appropriate Fourier coefficient. This sacrifice of finer detail provides conventional improvements in dynamic range. For comparison, FIG. 4F illustrates a logarithmic complex color visualization of whistling with no harmonics.

Figure 4G:
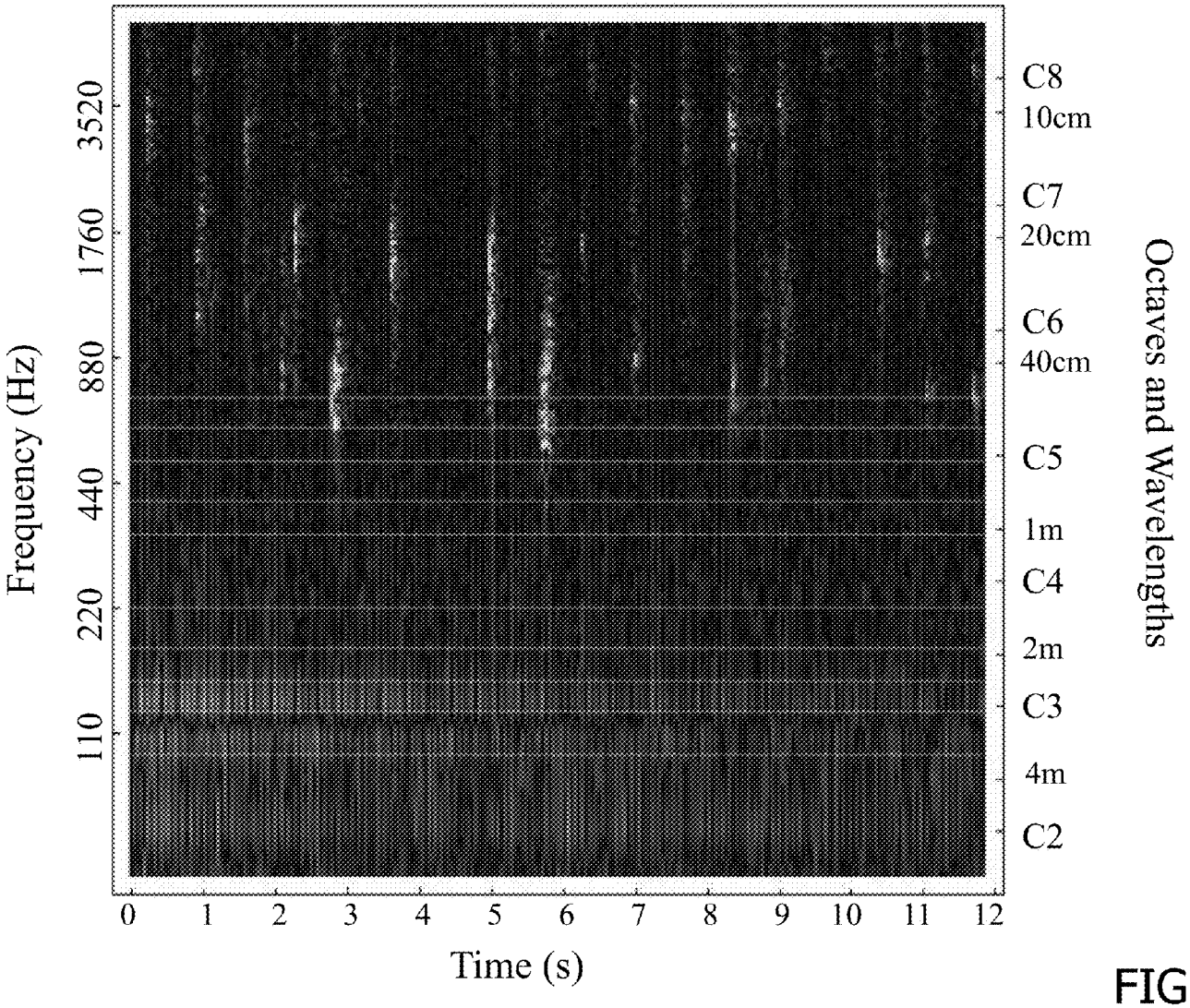
FIG. 4G depicts an exemplary embodiment of a recording of water dripping from a faucet in accordance with the present disclosure.
Figure 4H:
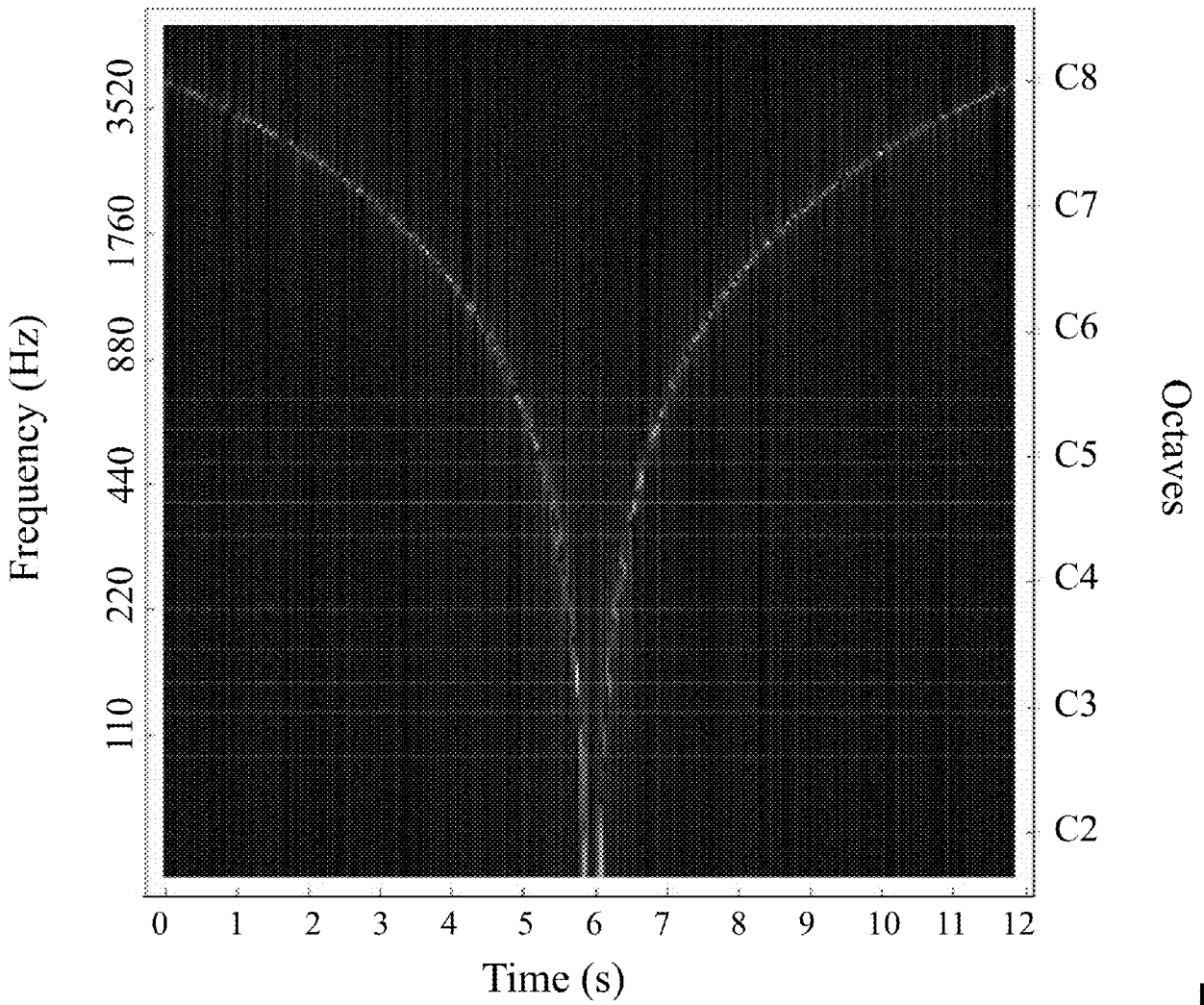
FIG. 4H depicts an exemplary embodiment of a linear ramp down and up in frequency calculated directly at 44100 Hertz and displayed on a log-frequency scale using Mathematica in accordance with the present disclosure.
Figure 4I:
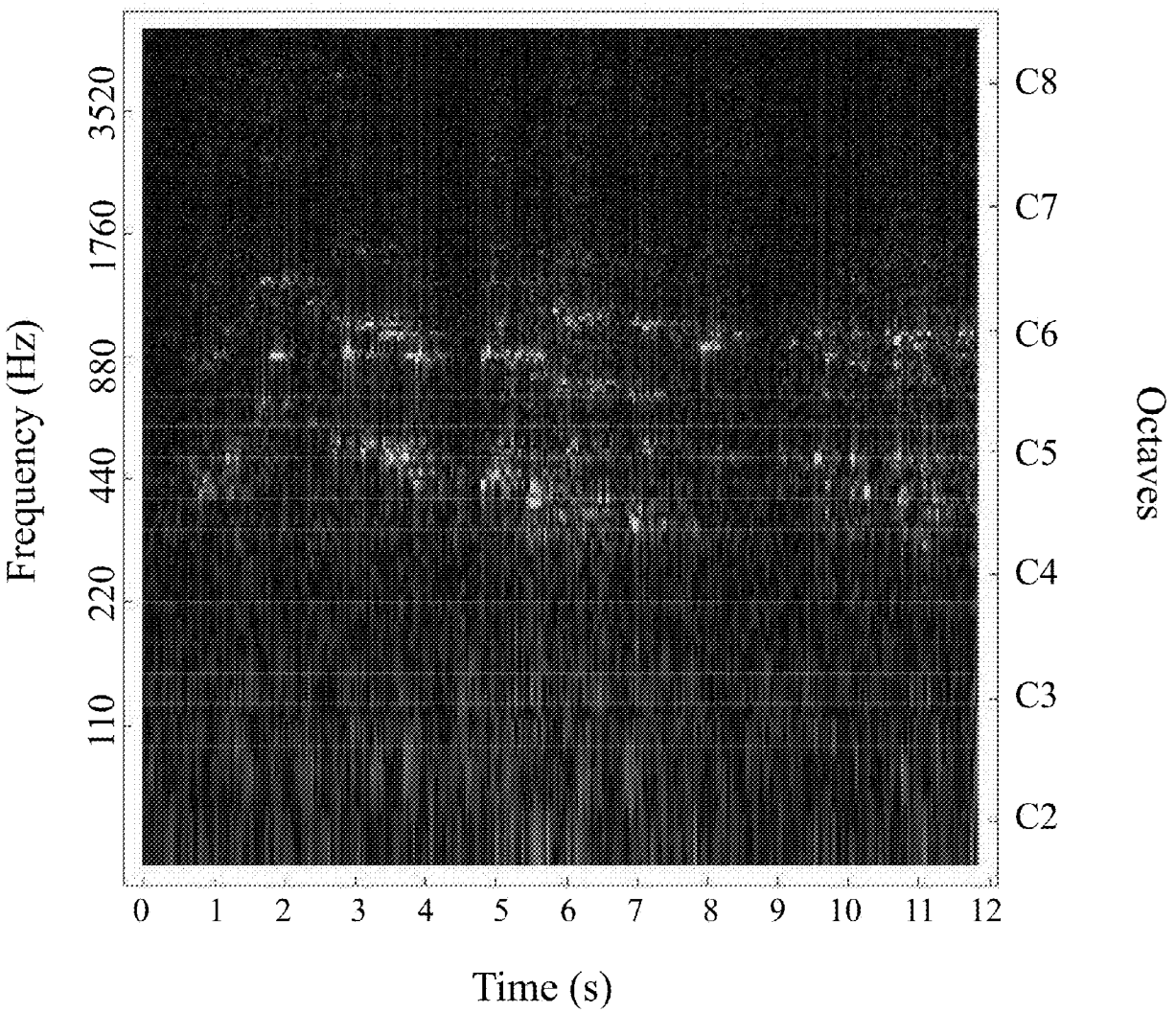
FIG. 4I depicts an exemplary embodiment of an excerpt from Edvard Grieg's "Anitra's Dance" performed by the Limburg Symfonie Orkest in accordance with the present disclosure.
Figure 4J:
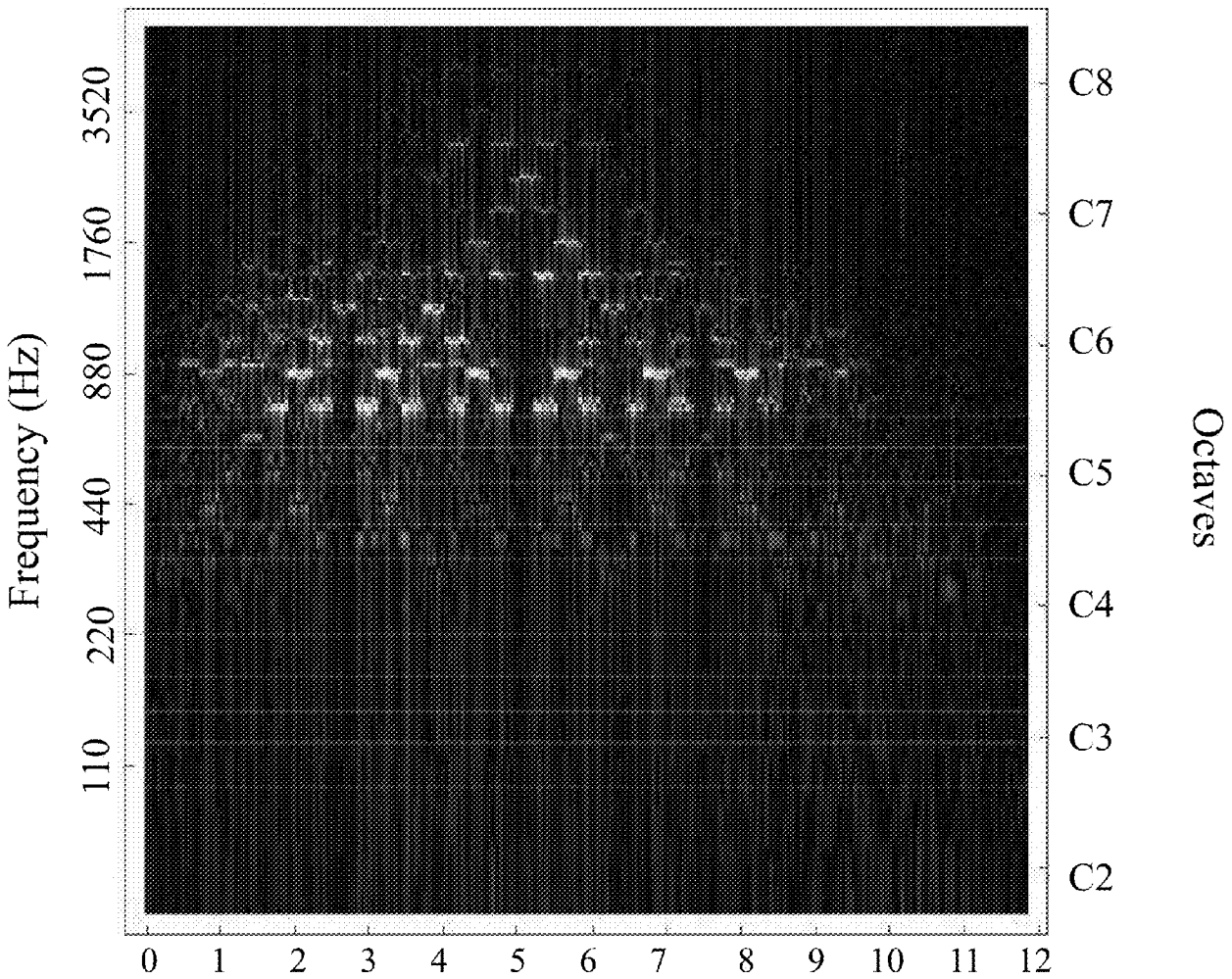
FIG. 4J depicts an exemplary embodiment of a series of chords generated by a cellular-automaton and played by flutes as simulated by a Mathematica model in accordance with the present disclosure.

FIGS. 4G-J provide exemplary embodiments showing application of the techniques described herein. FIG. 4G shows a recording of water dripping from a faucet, in which the colored bands indicating shifts in Fourier phase are noted. FIG. 4H illustrates a linear ramp down and up in frequency in a 12 second format, calculated directly at 44100 Hertz and then displayed on a log-frequency scale in Mathematica. FIG. 4I depicts an excerpt from Edvard Grieg's "Anitra's Dance" performed by the Limburg Symfonie Orkest. FIG. 4J shows a series of chords generated by a cellular-automaton as played by flutes and modeled using Mathematica.

In addition to displaying data on the complete sound wave, in some embodiments, a generated image is reverse-processed to recover the original signal, including the original phases imparted by the interference of the digital detector with the source wave, which contain information like relative angle to direction of source-wave propagation, etc. While CQTs have also been shown to be invertible, they do not display phase information explicitly and generally require additional computational resources compared to the discrete FFT. Since musical notation provides a practical reference, and since each pixel is able to be mapped back to the original sound, both human imitation and recovery to audio occur. Other modifications, such as adjustment of the frequency axis so Fourier coefficients match frequencies of particular tuning standards, are used to readily display whether a note is in appropriate tune, or if not, whether it is sharp or flat and by precisely how much. Such note-specific applications are completely accessible to anyone who reads music, and incorporates a new class of potential users of technically sophisticated audio analysis software.

Figure 5:
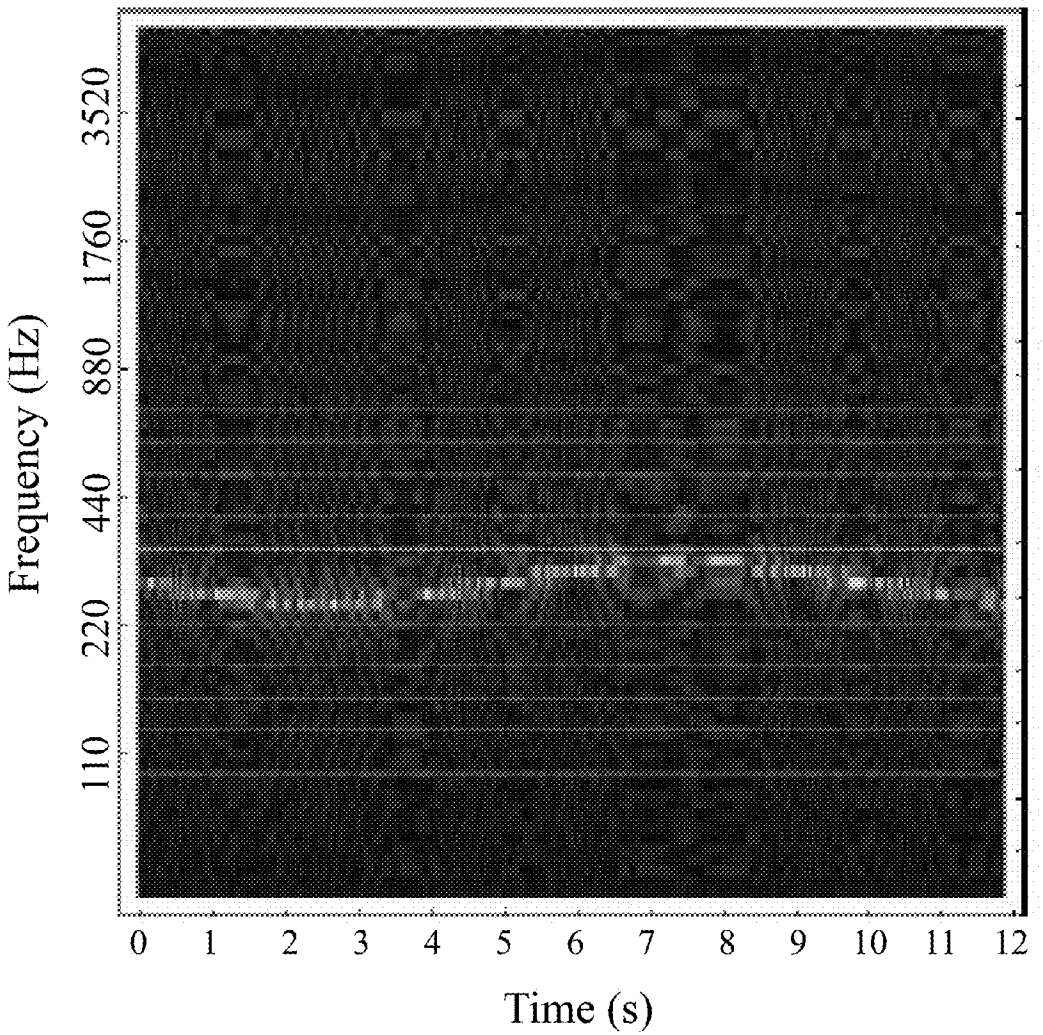
FIG. 5 depicts an exemplary embodiment of a half-note log-frequency rendition of a 10% frequency-modulated tone centered around 256 Hz in accordance with the present disclosure.

Browser implementations are only one facet of this development. More specialized implementations, e.g., in hardware instead of software will enable other uses. For instance, by doing a separate transform for each half-note in a log-frequency display, a user avoids all interpolation artifacts and puts any sound into playable music notation. This is illustrated in FIG. 5, which shows half-note log-frequency rendition of a 10% frequency-modulated tone centered around 256 Hz. In fact, in some embodiments, a single 12 second multi-octave chromatic scale is used to quantify the tuning state of all notes on a piano.

Figure 6:
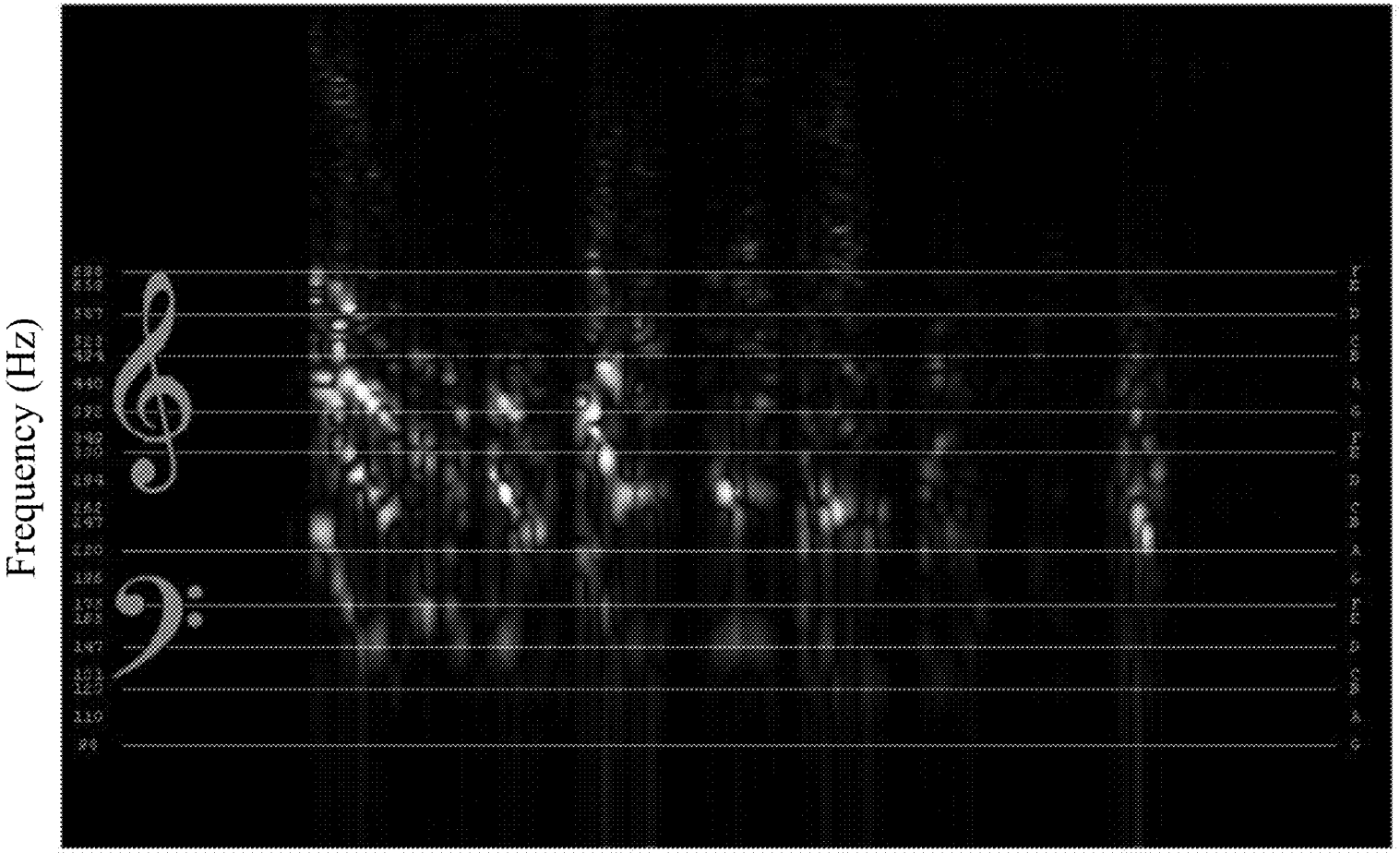
FIG. 6 depicts an exemplary embodiment of a visual recording of human speech created using a prototype Total Sound Videography program that uses logarithmic complex color to represent the Fourier coefficient offset of each frequency on the vertical axis as a hue in the pixel associated with that frequency in accordance with the present disclosure.

FIG. 6 shows a visual recording of human speech created using a prototype Total Sound Videography program that uses logarithmic complex color to represent the Fourier coefficient offset of each frequency on the vertical axis as a hue in the pixel associated with that frequency. This phase information, mainly arising from the digital detector discretely binning components of a continuous time signal, is largely ignored or potentially underutilized by many current audio analysis applications, and is furthermore likely undetectable by the human ear. The voice depicted in FIG. 6 is that of the inventor of the Linux operating system, Linus Torvalds, introducing himself.

Figure 7:
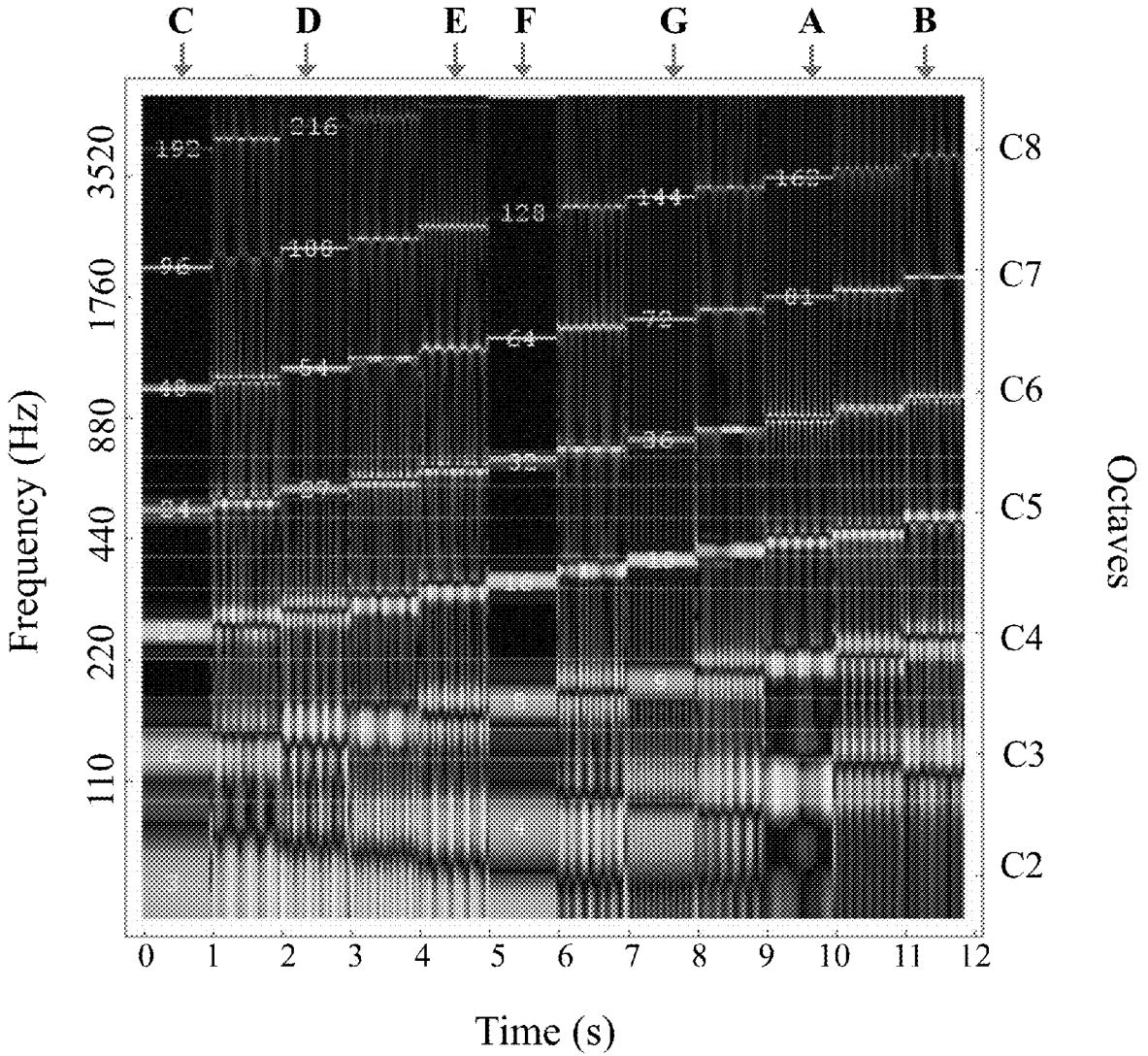
FIG. 7 depicts an exemplary embodiment of Pythagorean-ratio tuning to middle-C at 258.398 Hertz, making C2 an integral multiple frequency separation between Fourier coefficients in accordance with the present disclosure.

FIG. 7 shows Pythagorean-ratio tuning to middle-C at 258.398 Hertz, so as to make C2 an integral multiple of (in this case 12×) the 44100/2048=21.5332 Hertz separation between Fourier coefficients. This is an ancient form of just intonation tuning optimized for one specific key only, so as to maximize harmony between notes. Each octave starts with a one second C-note at the left, and works its way chromatically up to B at the right.

In some embodiments, the combination of processing and display techniques described herein enables total sound visualization that includes source-detector phase-interference information. The convenient and portable image format allows for improved accuracy in sound measurement, storage, analysis, and reproduction in a plethora of new and diverse environments and applications. Further development of robust audio visualization software, in parallel with semiconductor technology, will give the general public access to a growing variety of specialized, phase-interferometric tools to record, analyze, and recreate sounds on an increasingly real-time basis. As software is developed, applications which take advantage of traditional musical notation are likely to have the advantage of wider accessibility by the general public, as well as additional potential for musical reproduction and conceptual reference. Consequently, the ability to record and analyze audio in a visual form that retains precise information (i.e., regarding the physical orientation of the actual sound wave in space relative to the detector that recorded it) is significantly valuable for detailed sound-feature analysis.

In some embodiments, a sound is reconstructed from an image. A method for reconstructing a sound from an image comprises capturing a sound, creating a logarithmic color amplitude of the sound, creating a coefficient phase angle of the sound, generating an image of the sound by plotting the amplitude and the phase simultaneously and storing the generated image, and reverse processing the generated image to recover the sound. In some embodiments, such as utilizing various software applications, a sound is captured and stored as a generated image. Upon retrieval of the generated image, the sound is reconstructed by reverse processing of the plotted amplitude and phase of the generated image. In some embodiments, the generated image is not displayed. In some embodiments, the generated image is displayed before and/or after the sound is reconstructed.

When introducing elements of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

In view of the above, it will be seen that the several advantages of the disclosure are achieved and other advantageous results attained. As various changes could be made in the above processes and composites without departing from the scope of the disclosure, it is intended that all matter contained in the above description and shown in the accompanying drawings shall be interpreted as illustrative and not in a limiting sense.

What is claimed is:

1. An audio visualization method for recognition of a sound, the method comprising:

capturing a sound;

determining a brightness and saturation level corresponding to a logarithmic amplitude of the sound, determining a coefficient phase angle of the sound; and, displaying the amplitude and phase of the sound simultaneously to generate an image of the sound.

2. The method of claim 1, wherein the image is a pixel.

3. The method of claim 2, wherein the amplitude of the sound is displayed as the brightness and saturation of the pixel.

4. The method of claim 2, wherein the phase of the sound is displayed as a hue of the pixel.

5. The method of claim 1, wherein the image comprises a Fourier Transform (FT).

6. The method of claim 5, wherein the FT comprises a real data set and an imaginary data set.

7. The method of claim 5, wherein the FT is displayed as a vertical line of at least one pixel, wherein the amplitude of the sound is displayed by a brightness and saturation corresponding to a log of the intensity of the coefficient and wherein the phase of the sound is displayed by a hue corresponding to the coefficient phase.

8. A method of reconstructing a sound from an image, the method comprising:

capturing a sound;

determining a brightness and saturation level corresponding to a logarithmic amplitude of the sound, determining a coefficient phase angle of the sound;

displaying the amplitude and phase of the sound simultaneously to generate an image of the sound;

storing the sound as the generated image;

retrieving the generated image; and, reverse processing the generated image to recover the sound.

9. The method of claim 8, wherein the image is a pixel.

10. The method of claim 9, wherein the amplitude of the sound is displayed as the brightness and saturation of the pixel.

11. The method of claim 9, wherein the phase of the sound is displayed as a hue of the pixel.

12. The method of claim 8, wherein the image comprises a Fourier Transform (FT).

13. The method of claim 12, wherein the FT comprises a real data set and an imaginary data set.

14. The method of claim 12, wherein the FT is displayed as a vertical line of at least one pixel, wherein the amplitude of the sound is displayed by a brightness and saturation corresponding to a log of the intensity of the coefficient and wherein the phase of the sound is displayed by a hue corresponding to the coefficient phase.

15. A method of recreating a sound on a real-time basis, the method comprising:

capturing a sound;

determining a brightness and saturation level corresponding to a logarithmic amplitude of the sound, determining a coefficient phase angle of the sound; and, displaying the amplitude and phase of the sound simultaneously to generate an image of the sound;

analyzing the image of the sound; and, recreating the sound.

16. The method of claim 15, wherein the image is a pixel.

17. The method of claim 16, wherein the amplitude of the sound is displayed as the brightness and saturation of the pixel.

18. The method of claim 16, wherein the phase of the sound is displayed as a hue of the pixel.

19. The method of claim 15, wherein the image comprises a Fourier Transform (FT).

20. The method of claim 19, wherein the FT comprises a real data set and an imaginary data set.

* * * * *